US008387473B2

(12) United States Patent
Breeding et al.

(10) Patent No.: US 8,387,473 B2
(45) Date of Patent: Mar. 5, 2013

(54) TEMPERATURE SENSING SOOTBLOWER

(75) Inventors: Charlie L. Breeding, Signal Mountain, TN (US); Danny S. Tandra, Johns Creek, GA (US); Bruce K. Townsend, Flowery Branch, GA (US); Charles A. Strawn, Conyers, GA (US)

(73) Assignee: Clyde Bergemann, Inc., Atlanta, GA (US)

( * ) Notice: Subject to any disclaimer, the term of this patent is extended or adjusted under 35 U.S.C. 154(b) by 271 days.

(21) Appl. No.: 13/010,824

(22) Filed: Jan. 21, 2011

(65) Prior Publication Data

US 2012/0186540 A1 Jul. 26, 2012

(51) Int. Cl.
*G01D 21/00* (2006.01)
*F28G 9/00* (2006.01)
*B08B 3/00* (2006.01)

(52) U.S. Cl. ..... 73/866.5; 122/390; 134/113

(58) Field of Classification Search ..... None
See application file for complete search history.

(56) References Cited

U.S. PATENT DOCUMENTS

| | | | | |
|---|---|---|---|---|
| 382,710 | A | 8/1974 | Adiutori | |
| 518,148 | A | 1/1993 | Labbe et al. | |
| 5,615,953 | A * | 4/1997 | Moskal | 374/7 |
| 6,073,641 | A | 6/2000 | Bude et al. | |
| 736,050 | A1 | 4/2008 | Habib et al. | |
| 2003/0047196 | A1 * | 3/2003 | Bartels et al. | 134/19 |
| 2006/0005786 | A1 * | 1/2006 | Habib et al. | 122/379 |
| 2010/0212609 | A1 | 8/2010 | Adams | |
| 2011/0056313 | A1 * | 3/2011 | Dahlen et al. | 73/866.5 |

FOREIGN PATENT DOCUMENTS

| | | | |
|---|---|---|---|
| EP | 1 939 569 | A1 | 7/2008 |
| EP | 1939569 | A1 * | 7/2008 |
| WO | WO 2012099594 | * | 7/2012 |

* cited by examiner

*Primary Examiner* — Hezron E Williams
*Assistant Examiner* — Nathaniel Kolb
(74) *Attorney, Agent, or Firm* — Michael J. Mehrman; Mehrman Law Office P.C.

(57) ABSTRACT

A temperature sensing sootblower that may be configured as a modification to an existing sootblower or a specially constructed sootblower that, in addition to its normal soot blowing functions, has the capability to measure the flue gas, lance tube, and/or cleaning fluid temperatures. One or more thermocouples or other temperature measuring devices are carried by the sootblower lance tube that is inserted into the boiler. This allows for the temperature of the flue gas, lance tube, and cleaning fluid to be measured as the sootblower lance tube is inserted into and retracted from the boiler. Multiple temperature measuring devices may be located on the sootblower lance to measure the temperature across heat transfer surfaces and at different locations along the lance tube. A data transfer device transmits the temperature measurements from the rotating thermocouple to a non-rotating data acquisition unit for use in boiler cleaning and other operations.

22 Claims, 11 Drawing Sheets

TEMPERATURE SENSING SOOTBLOWER

BACKGROUND

The entrainment of fly ash particles from the lower furnace of an industrial boiler to the convection sections of the boiler is an inevitable process. The accumulation of these particles in the fireside heat exchanger surfaces reduces the boiler thermal efficiency, creates a potentially corrosive environment at the boiler tube surfaces and, if the accumulation is not properly controlled, may also lead to costly unscheduled boiler shutdowns due to plugging of the gas passages.

Knowledge of the flue gas temperatures across the boiler heat transfer surfaces is therefore an important piece of information that can be used to evaluate fireside deposit characteristics, to improve boiler cleaning operation through intelligent deposit removal processes, and to optimize boiler operation and combustion processes. Conventional temperature sensors positioned in fixed locations on boiler walls or other internal boiler structures do not monitor flue gas temperatures across the boiler heat transfer surfaces. There is, therefore, a continuing need for effective ways of monitoring the internal temperature of flue gasses across heat transfer surfaces inside of industrial boilers.

Sootblowers are by far the most widely used equipment to remove the fireside deposit accumulations in industrial boilers, such as oil-fired, coal-fired, trash-fired, waste incinerator, as well as boilers used in paper manufacturing, oil refining, steel, and aluminum smelting and other industrial enterprises. A sootblower consists of a lance tube with one or more nozzles. During the deposit removal process, the sootblower lance rotates and extends through a small opening in the boiler wall, while blowing high pressure cleaning fluid (e.g., steam, air or water) directed into the tube banks. After the lance is fully extended, it rotates in the opposite direction as it retracts to its original inactive state.

The sootblower carriage consists of one or two electric motor(s), a gearbox and a packing housing. The electric motor is the main drive that moves the lance tube forward and backward during the cleaning cycle. The motor converts electrical energy into rotation motion, which is then used by the gearbox to rotate and move the lance tube along the gear rack. As the steam enters a sootblower, it is directed to four components in the following order: poppet valve, feed tube, lance tube, and nozzles. The lance tube is the main component that travels within the boiler while supplying the sootblower nozzles with high pressure steam directed by jets toward the boiler tubes. The lance travel includes insertion into and retraction from the boiler. During the cleaning process, the lance extends into the boiler and forms a structure similar to a cantilevered beam. Hence, the lance has to be designed to have sufficient strength to support its own weight in a high temperature environment.

To avoid overheating the lance tube during internal boiler operation, the blowing fluid, which also acts as a cooling medium, needs to be supplied continuously to the lance. The minimum amount of the cleaning media required to prevent the lance from overheating is known as the minimum cooling flow. The minimum cooling flow of a lance tube depends on the material, the length of the lance tube, the steam and flue gas temperatures. Knowledge of the lance tube temperatures as the lance is being exposed to hot flue gas inside the boiler is very important to prevent lance tube overheating and to devise emergency sootblower retraction control strategy. A continuing need therefore exists for effective ways for monitoring the temperature of the lance tube as the lance is exposed to hot flue gas inside the boiler.

SUMMARY OF THE INVENTION

The present invention meets the needs described above in a temperature sensing sootblower that includes an elongated lance tube configured to travel adjacent to and across a heat transfer surface in a boiler while directing a cleaning fluid through one or more nozzles toward the heat transfer surface to remove fireside deposits from the heat transfer surface. The lance tube carries a temperature sensor that is configured to obtain temperature measurements of the flue gas within the boiler, lance tube, and/or cleaning fluid while the lance is located within the boiler. A boiler cleaning controller may control boiler cleaning operations based on the temperature measurements. A data acquisition unit typically receives and records the temperature measurements from the temperature sensor and transmits the temperature measurements to the boiler cleaning controller.

The temperature sensing sootblower also includes a data transfer device that transfers the temperature measurements from the temperature sensor to the data acquisition unit while the temperature sensor rotates with the lance tube. In particular, the data transfer device may be a slip ring fixed to the lance tube.

To measure the temperature of the flue gas as opposed to the lance tube and avoid the cooling effect of the cleaning fluid on the flue gas, the temperature sensing sootblower may include a lance tube extension supporting the temperature sensor beyond a leading end of the lance tube in an insertion direction of the lance tube. The lance tube extension may also support the temperature sensor beyond the lance tube extension in the insertion direction.

The temperature sensing sootblower may include a groove in the lance tube and the temperature sensor may be a thermocouple positioned within the grove. A welding rod may be positioned above the thermocouple within the grove with an overlay weld positioned above the welding rod sealing the thermocouple within the grove.

The invention may also be practiced as a temperature sensing sootblower that includes an elongated lance tube and a temperature sensor carried by the lance tube configured to obtain temperature measurements of the lance tube while the lance tube travels within the boiler. The flue gas temperature sensor and the lance tube temperature sensor may also be combined, such that the lance tube carries a first temperature sensor configured to obtain temperature measurements of flue gas within the boiler across the heat transfer surface as the lance tube travels across the heat transfer surface and a second temperature sensor configured to obtain temperature measurements of the lance tube while the lance tube travels within the boiler. In this case, the temperature sensors may be a pair of thermocouples located in a stranded wire positioned within the grove. Multiple temperature sensors also may be located along the lance tube if desired.

In addition, the temperature sensing sootblower may also include a thermocouple in contact with the lance tube for measuring the temperature of the lance tube and/or a thermocouple extending through a hole in the lance tube into an interior of the lance tube for measuring the temperature of a cleaning fluid inside the lance tube. The boiler cleaning controller may be configured to retract the lance tube in response to temperature measurements from the temperature sensor indicating that the lance tube has exceeded a predetermined temperature.

In view of the foregoing, it will be appreciated that the present invention avoids the drawbacks of prior boiler temperature measuring systems and provides an improved temperature sensing sootblower. The specific techniques and structures for creating the temperature sensing sootblowers, and thereby accomplishing the advantages described above, will become apparent from the following detailed description of the embodiments and the appended drawings and claims.

DETAILED DESCRIPTION OF THE PREFERRED EMBODIMENTS

This invention can be embodied in a temperature sensing sootblower that may be configured as a modification to an existing sootblower or a specially constructed sootblower that, in addition to its normal soot blowing functions, has the capability to measure the flue gas, lance tube, and/or cleaning fluid temperatures. One or more thermocouples or other temperature measuring devices are carried by the sootblower lance tube that travels within the boiler. This allows for the temperature of the flue gas, lance tube, and/or cleaning fluid to be measured as the sootblower lance tube is inserted into and retracted from the boiler. Multiple temperature measuring devices may be located on the sootblower lance to measure the temperature across heat transfer surfaces and at different locations along the lance tube. A data transfer device transmits the temperature measurements from the rotating thermocouple to a non-rotating data acquisition unit for use in boiler cleaning and other operations.

A data transfer device, such as a slip ring, is used to transfer the signal from the thermocouple to a data acquisition unit located on the non-rotating part of the sootblower. The invention may also be used in sootblowers that are partially inserted in the boiler (sometimes called half-track sootblowers). It may also be used in sootblowers that are continually inserted into the boiler gas path. The temperature sensor may be a thermocouple, a Resistance Temperature Detector (RTD), or other suitable type of sensing device that is attached to the lance tube of the sootblower.

Figure 1:
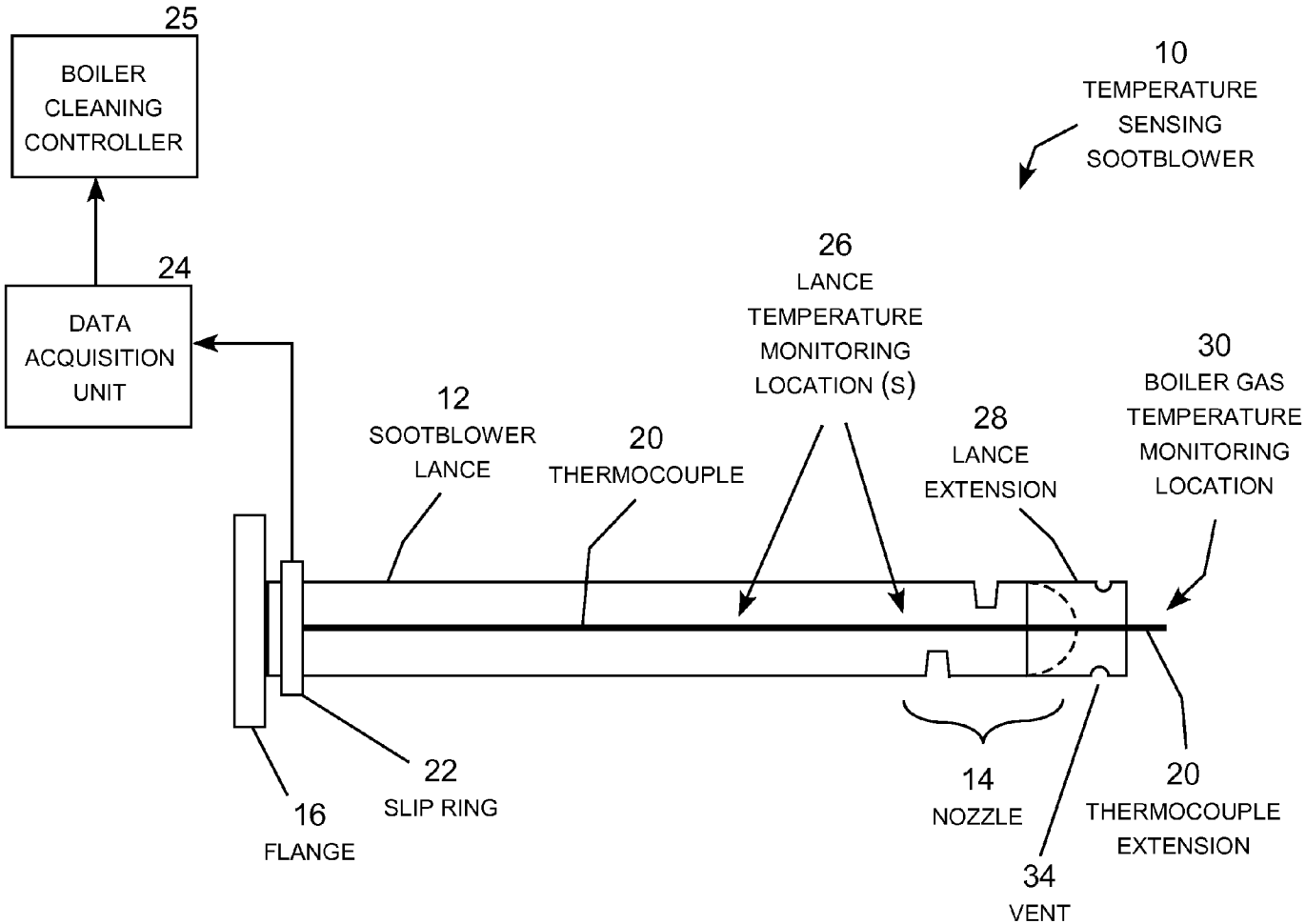
FIG. 1 is a schematic illustration of a temperature sensing sootblower.

FIG. 1 is a schematic illustration of the temperature sensing sootblower 10 including the lance tube 12 extending from a flange 16 that supports one end of the lance tube to the nozzles 14. The lance tube is inserted through a hole in the boiler wall into interior of the boiler, where it is extended and retracted to clean heat transfer surfaces inside the boiler. The nozzle(s) can be installed anywhere in the lance tube where one or more cleaning fluids, such as steam, air or water, are supplied to the nozzle(s) to clean the fireside deposits from internal boiler heat transfer surfaces. The lance tube rotates as it travels in the insertion direction (from flange toward the tip of the lance), blowing a spiral of cleaning fluid as is travels across an adjacent heat transfer surface. The lance tube rotates in the opposite direction (from the tip of the lance toward flange) as it travels in the retraction direction.

To measure the temperature of the flue gas and the lance tube inside the boiler, the temperature sensing sootblower 10 carries temperature sensors, in this illustration a multi strand thermocouple 20 that extends longitudinally along the lance tube. The thermocouple is connected to a data transfer device, in this illustration a slip ring 22 that transfers the temperature measurements from the thermocouple to a data acquisition unit 24 while the thermocouple rotates with the lance tube. The data acquisition unit 24, in turn, transmits the temperature measurements to a boiler cleaning controller 25 or other processor that may use the measurements for a variety of purposes, such as displaying the temperature profile across heat transfer surfaces inside the boiler, activating sootblowers and other boiler cleaning equipment, adjusting boiler operation, retracting the lance tube to prevent overheating, and so forth. As the data acquisition unit 24 includes a processor, it may create temperature and perform some of these functions.

The thermocouple 20 is typically a stranded wire containing a number of two-wire thermocouples allowing for multiple temperature sensing locations 26 along the lance tube. For example, the thermocouple may include six wires providing three Type K thermocouples. This provides knowledge of the lance tube temperature so that the lance tube can be retracted to prevent overheating. The temperature along the lance tube may be monitored at multiple locations, as desired.

The thermocouple may also include a boiler gas monitoring location 30 positioned beyond the tip of the lance in the lance insertion direction. To obtain the temperature of the boiler flue gas rather than the lance tube, a lance tube extension 28 supports the thermocouple beyond the tip of the lance in the lance insertion direction. The thermocouple also extends a bit beyond the lance tube extension 28 so that the temperature monitoring location 30 is supported in the flue gas without physically touching the lance tube extension. For example, the lance tube extension 28 may extend four to six inches beyond the tip of the lance and the thermocouple 20 may extend another half inch to the boiler gas monitoring location 30. The lance tube extension 28 may also include one or more vents 34 to for cooling purposes. The lance tube extension is typically made from the same type of material as the lance tube and welded onto the tip of the lance.

Figure 2:
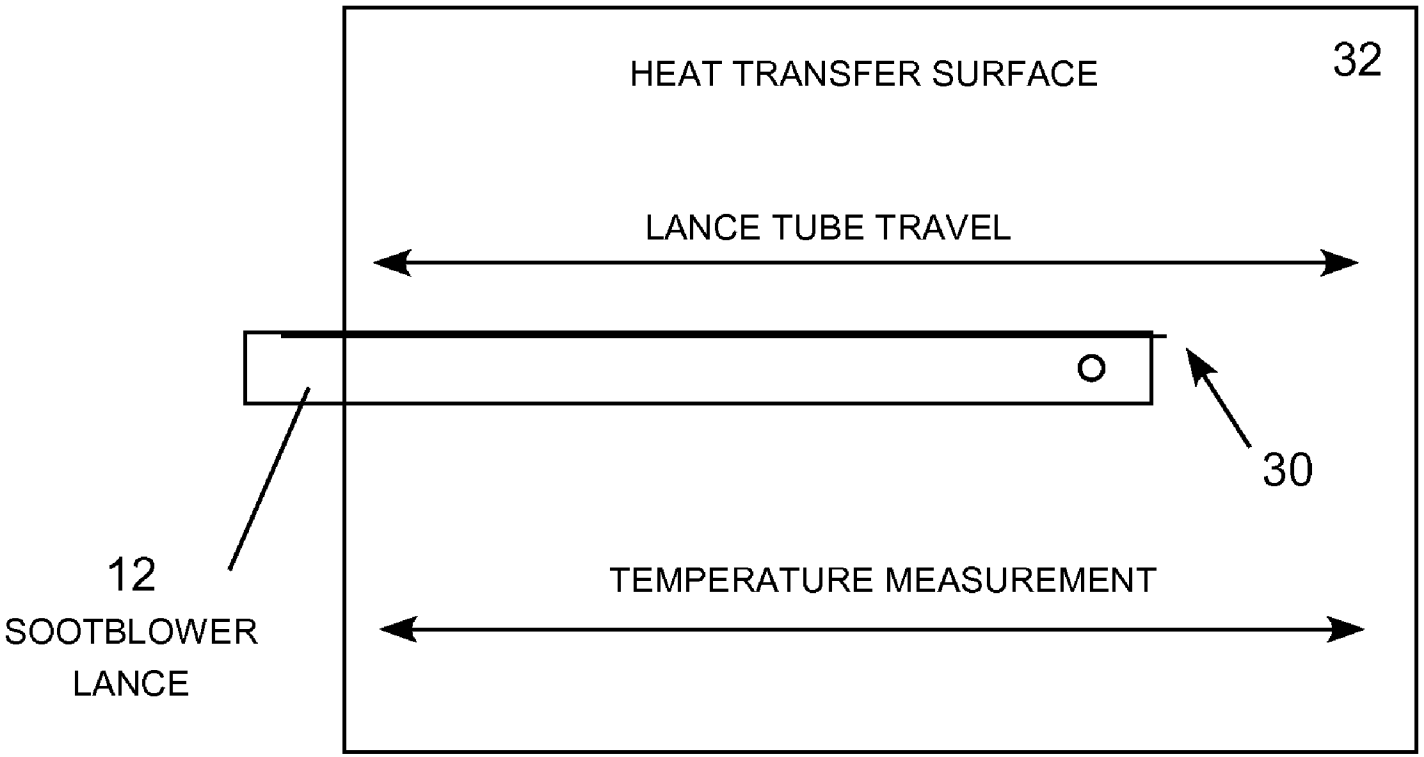
FIG. 2 is a conceptual illustration of the temperature sensing sootblower measuring the temperature of flue gas across a heat transfer surface in a boiler.

FIG. 2 is a conceptual illustration of the temperature sensing sootblower 10 measuring the temperature of flue gas across a heat transfer surface 32 in a boiler. The boiler gas temperature monitoring location 30 of the thermocouple 20 measures the temperature of the flue gas as the sootblower lance 12 travels adjacent to and across the heat transfer surface 32. The data acquisition unit 24, the boiler cleaning controller 25, or another processor creates a profile of the internal temperature of the boiler across the heat transfer surface. The temperature profile generally indicates whether the heat transfer surface is carrying fireside deposits reducing the heat transfer capability of the heat transfer surface, allowing for intelligent boiler operation including intelligent sootblower operation. The temperature monitoring location(s) 26 also measure the temperature of the lance tube allowing the lance tube to be retracted to prevent overheating.

Figure 3:
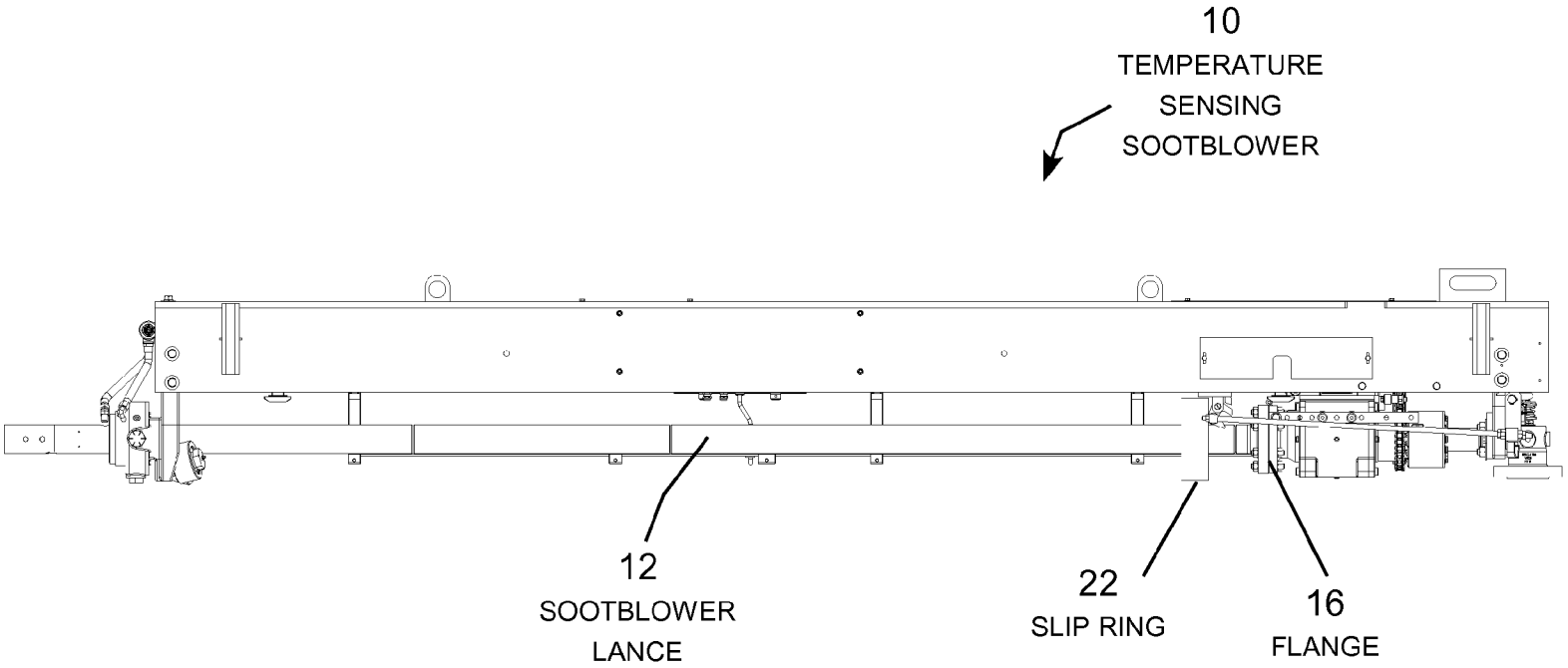
FIG. 3 is a side view of a temperature sensing sootblower showing the location of the slip ring data transfer device.

FIGS. 3-7 show an illustrative embodiment of the temperature sensing sootblower substantially to scale. FIG. 3 is a side view of the temperature sensing sootblower 10 indicating the location of the slip ring data transfer device 22 and the flange 16. The slip ring is typically mounted to a non-rotating plate positioned about six inches ahead of the flange 16 to prevent damage to the slip ring in the event of a steam leak from the flange. The slip ring includes a ball bearing or similar race with an inner sleeve that rotates with the lance tube and a non-rotating outer sleeve fixed to the plate. Wires connected to the inner sleeve are connected to the thermocouple while wires connected to the outer sleeve are connected to the data acquisition unit. This allows the slip ring to transmit the temperature measurements from the rotating thermocouple to the non-rotating data transfer unit. Another type of data transfer device may be used, however, such as a wireless data link between the thermocouple and the data acquisition unit or any other suitable type of data transfer device.

Figure 4:
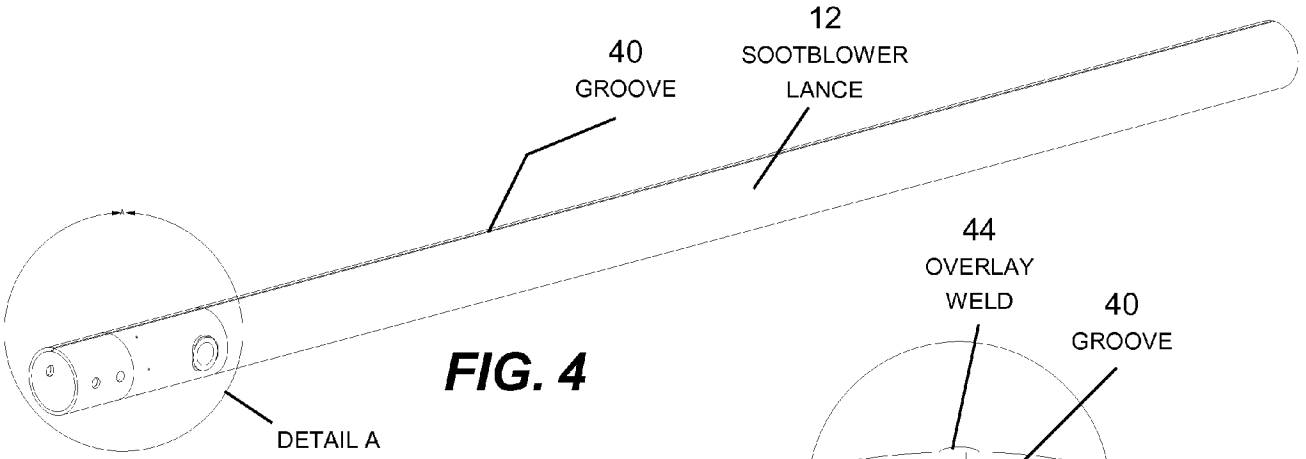
FIG. 4 is a perspective view of a temperature sensing sootblower lance.
Figure 7:
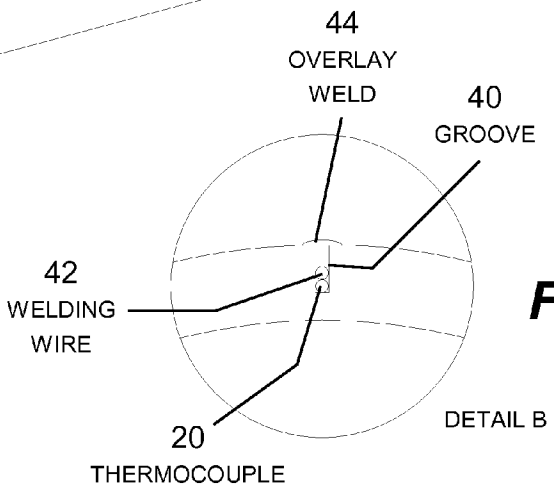
FIG. 7 is an enlarged view of Detail B of FIG. 6 showing the thermocouple temperature sensor, protective welding wire, and overlay weld.
Figure 6:
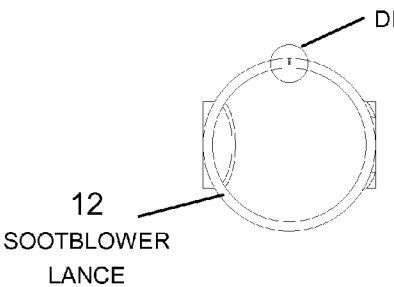
FIG. 6 is an end view of the temperature sensing sootblower lance.
Figure 5:
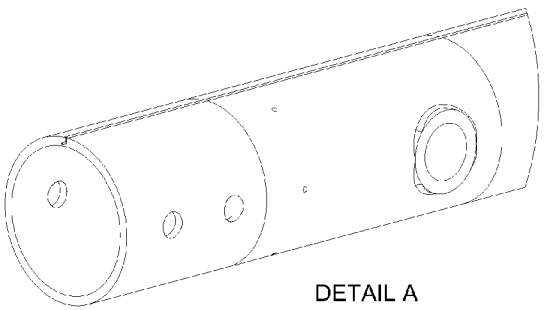
FIG. 5 is an enlarged view of Detail A of FIG. 7 showing the end of the temperature sensing sootblower lance.
Figure 8:
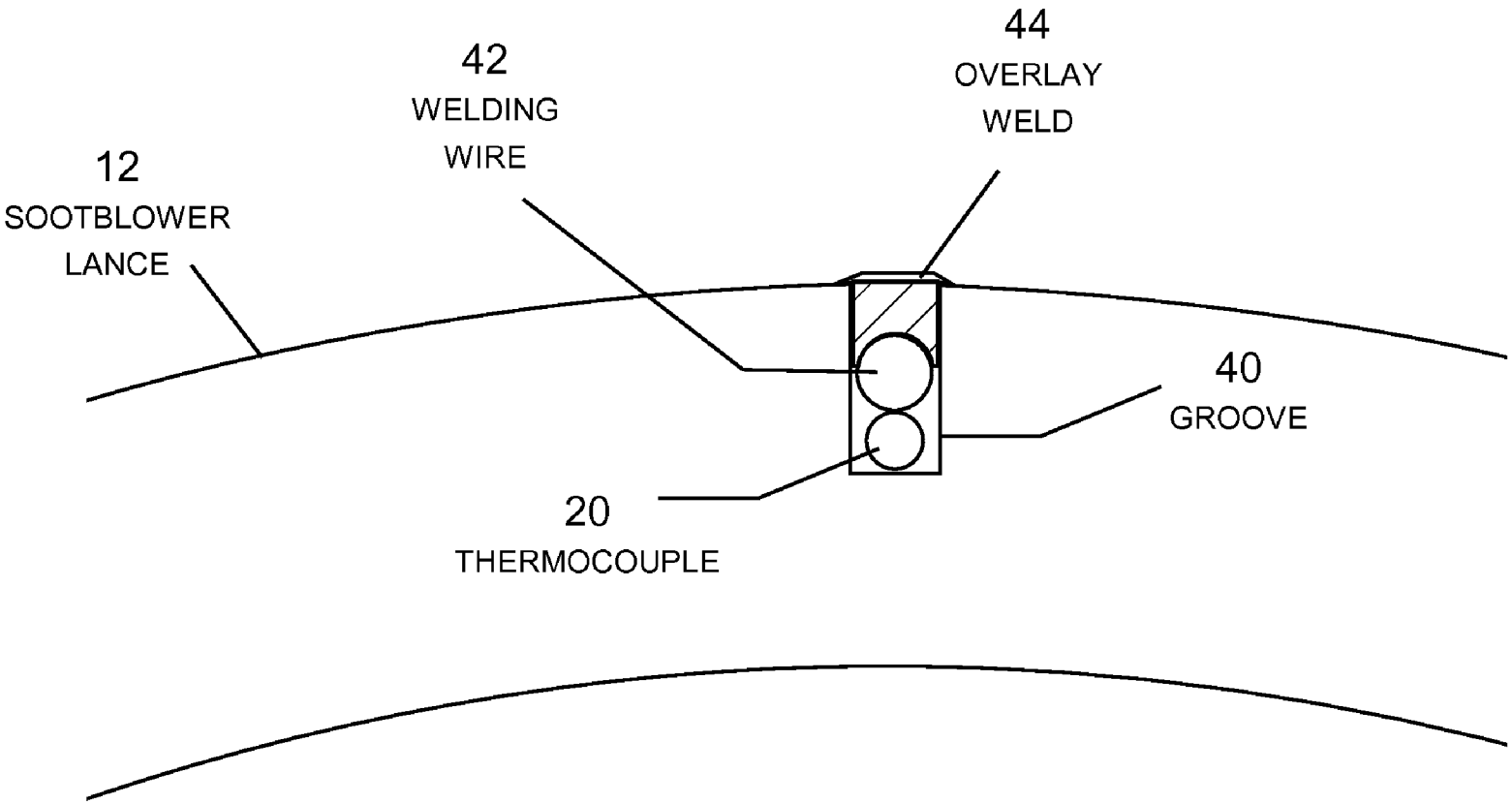
FIG. 8 is a further enlargement of the groove in the temperature sensing sootblower carrying the thermocouple temperature sensor, protective welding wire, and overlay weld.

FIG. 4 is a perspective view of the tip of the lance portion of the temperature sensing sootblower lance 12 with the groove 40. FIG. 5 is an enlarged view of Detail A of FIG. 4 showing the end of the temperature sensing sootblower lance including the lance tube extension 28. FIG. 6 is an end view of the temperature sensing sootblower lance 12 and FIG. 8 is an enlarged view of a Detail B of FIG. 7 showing the groove 40. FIG. 8 is a further enlargement of the groove 40 carrying the thermocouple 20, the protective welding wire 42, and the overlay weld 44. The groove, which extends from the slip ring to the end of the lance tube extension, may be machined or cut into the lance tube with saw. The thermocouple 20 is positioned at the bottom of the groove 40 with the protective welding wire 42 positioned above the thermocouple. An overlay weld 44 is welded over the grove to seal the thermocouple in the groove. The protective welding wire prevents the thermocouple from being damaged during the welding process. The groove 44 is cut approximately the same size as the protective welding wire to provide a snug interference fit between the groove and the welding wire. The thermocouple may be the same size or a smaller than the welding wire.

Figure 9:
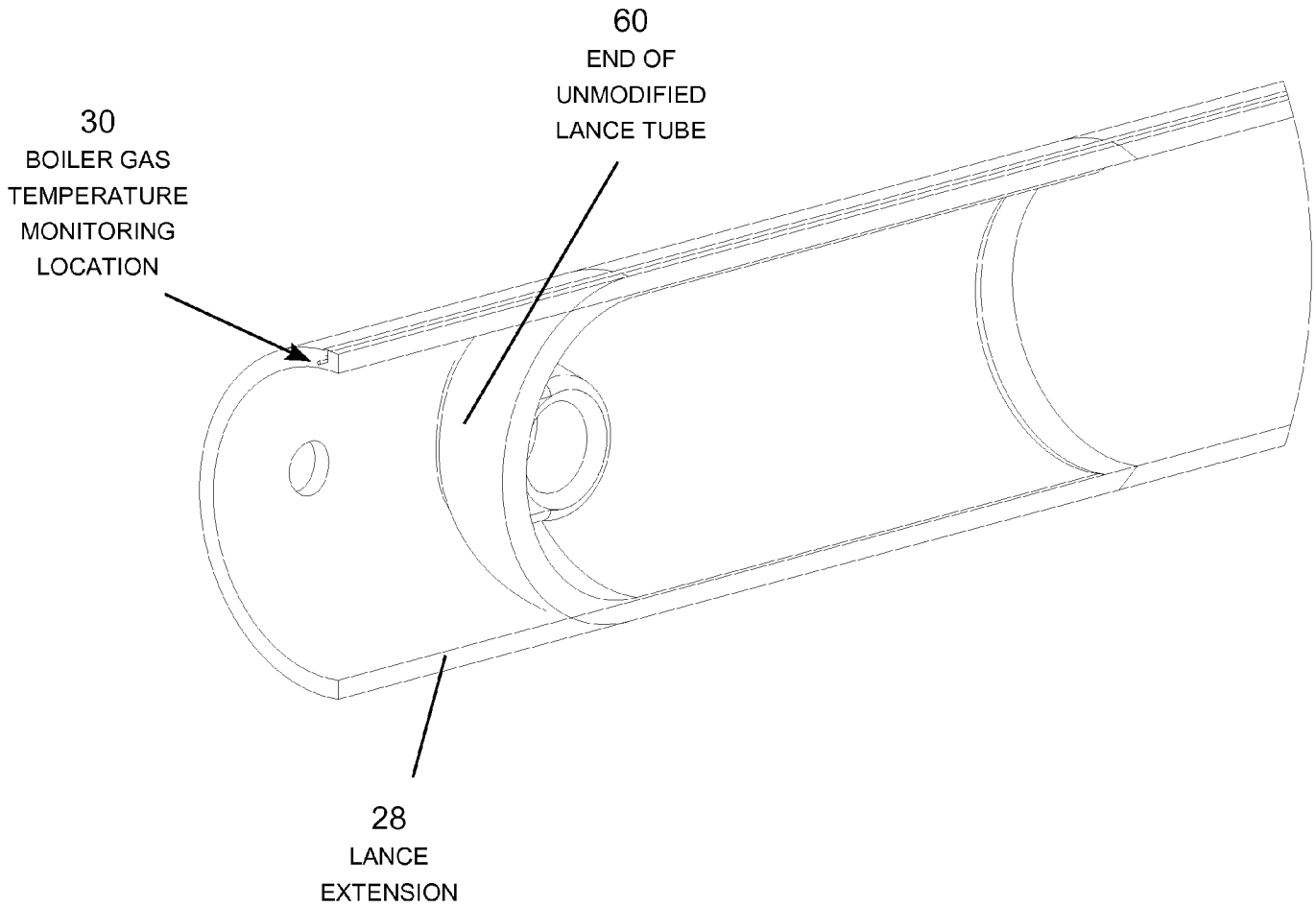
FIG. 9 is a cut away view of the end of the temperature sensing lance tube showing the boiler gas monitoring location and the end of the unmodified lance tube.

FIG. 9 is an enlarged cut-away view of the end of the temperature sensing sootblower lance tube 12 showing the boiler gas temperature monitoring location 30 at the end of the thermocouple extending beyond the end of the lance tube extension 28. FIG. 9 also shows the rounded end 60 of the unmodified lance tube.

In view of the foregoing, it will be appreciated that present invention provides significant improvements in sootblowers and boiler temperature monitoring systems and that numerous changes may be made therein without departing from the spirit and scope of the invention as defined by the following claims.

Figure 10:
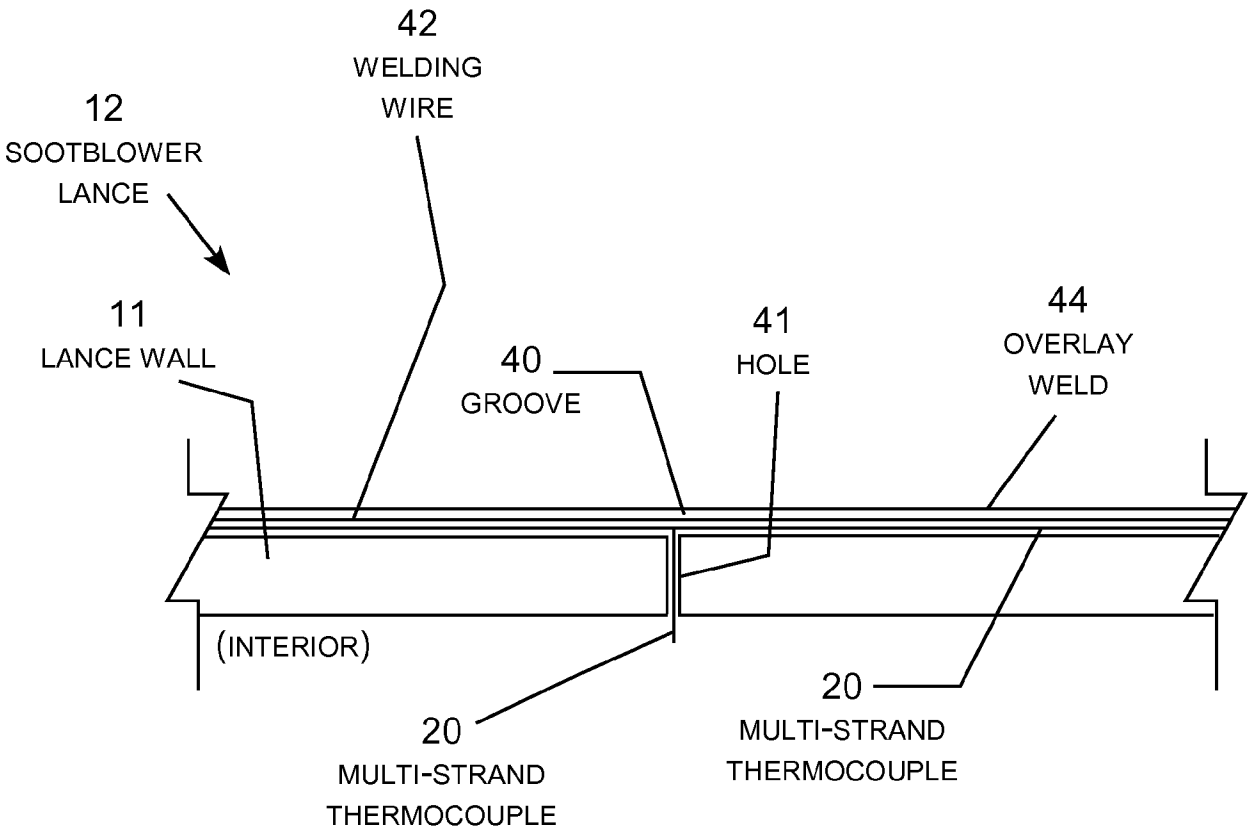
FIG. 10 is a conceptual cross sectional side view of a sootblower lance carrying a temperature sensor for measuring the temperature of the cleaning fluid inside the lance.

FIG. 10 is a conceptual cross sectional side view of a wall 11 of the sootblower lance 12 carrying a multi-strand thermocouple 20 within a grove 40, as described previously. In this example, the sootblower include a hole 41 extending from the grove through the wall 11. This allows a thermocouple to extend through the lance wall into the interior of the lance tube where it measures the temperature of the cleaning fluid inside the lance. It will be appreciated that any number of thermocouples can be deployed to measure the temperature of the lance tube, the gas outside the lance tube, and/or the cleaning fluid inside the lance tube at any desired locations along the lance tube. Thermocouples may also be used to measure the temperature of the lance tube on the inner surface, the outer surface, or at any desired depth within the lance tube wall.

Figure 11:
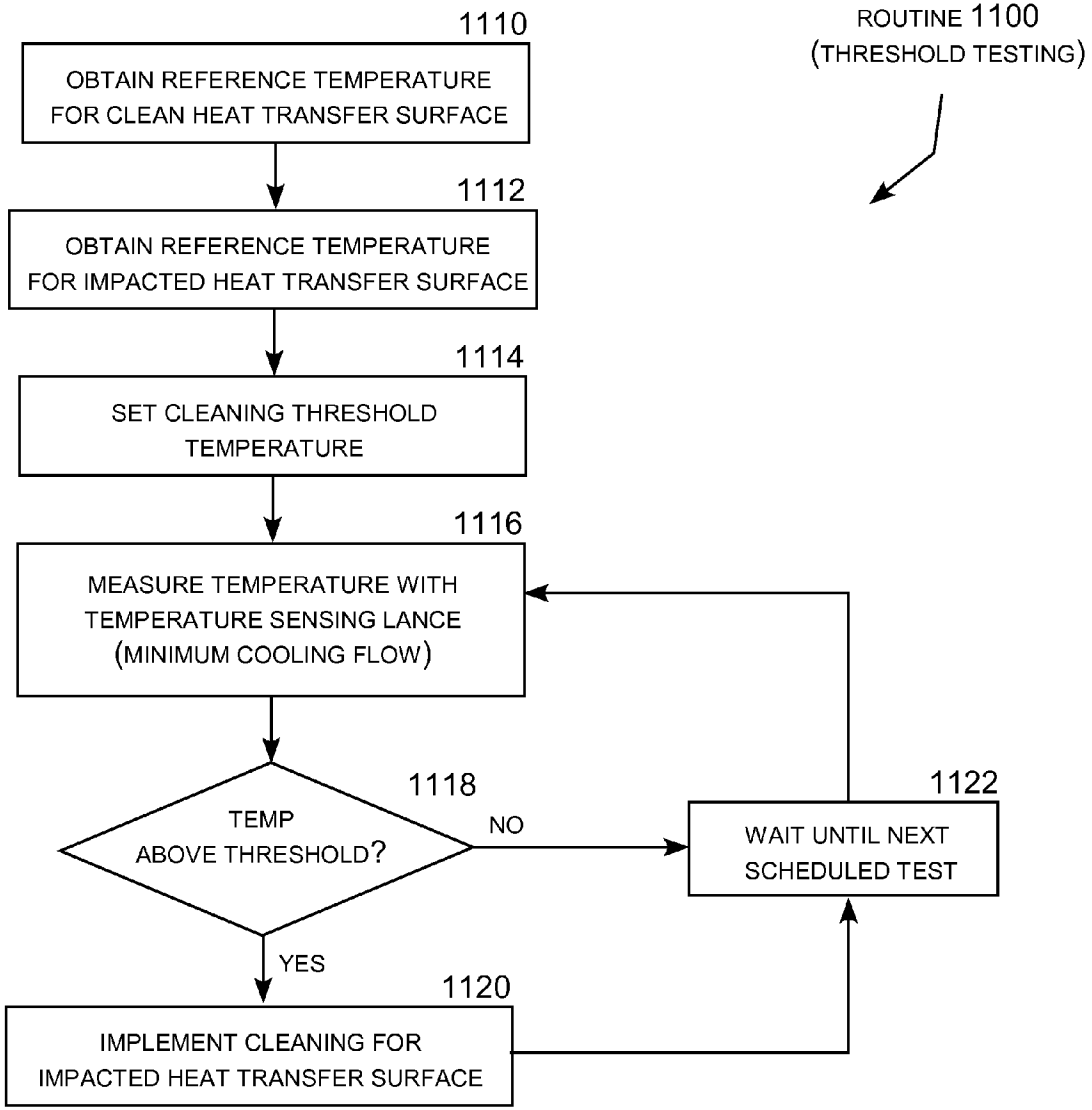
FIG. 11 is a logic flow diagram illustrating a routine for activating a boiler cleaning operation in response to flue gas temperatures measured with the temperature sensing sootblower.

FIG. 11 is a logic flow diagram illustrating a routine 1100 for activating a boiler cleaning operation in response to flue gas temperatures measured with the temperature sensing sootblower. In step 1110, a reference temperature for a clean heat transfer surface is obtained, typically by measuring the temperature of the heat transfer surface when it is known to be in a clean state or through computer simulation. Step 1110 is followed by step 1112, in which a reference temperature for a heat transfer surface impacted by accumulated slag is obtained, again by measuring the temperature of the heat transfer surface when it is known to be in an impacted state or through computer simulation. Step 1112 is followed by step 1114, in which the boiler cleaning controller is programmed with a cleaning threshold temperature based on the clean and impacted reference temperatures. For example, the cleaning threshold temperature may be set to be half way between the clean and impacted reference temperatures. Step 1114 is followed by step 1116, in which the boiler cleaning controller activates the temperature sensing sootblower to measure the boiler temperature while maintaining a minimum cleaning fluid flow necessary to avoid overheating of the lance (see FIG. 14). Step 1116 is followed by step 1118, in which the boiler cleaning controller determines whether the measured temperature is above the cleaning threshold temperature. If the measured temperature is above the cleaning threshold temperature, the "YES" branch is followed to step 1120, in which the sootblower is activated to clean the detected impacted surface. If the measured temperature is not above the cleaning threshold temperature, the "NO" branch is followed to step 1122, in which the sootblower cleaning controller waits for another scheduled test. Step 1120 is also followed by step 1122, which loops to step 1116, in which the boiler temperature is measured with the temperature sensing sootblower.

Figure 12:
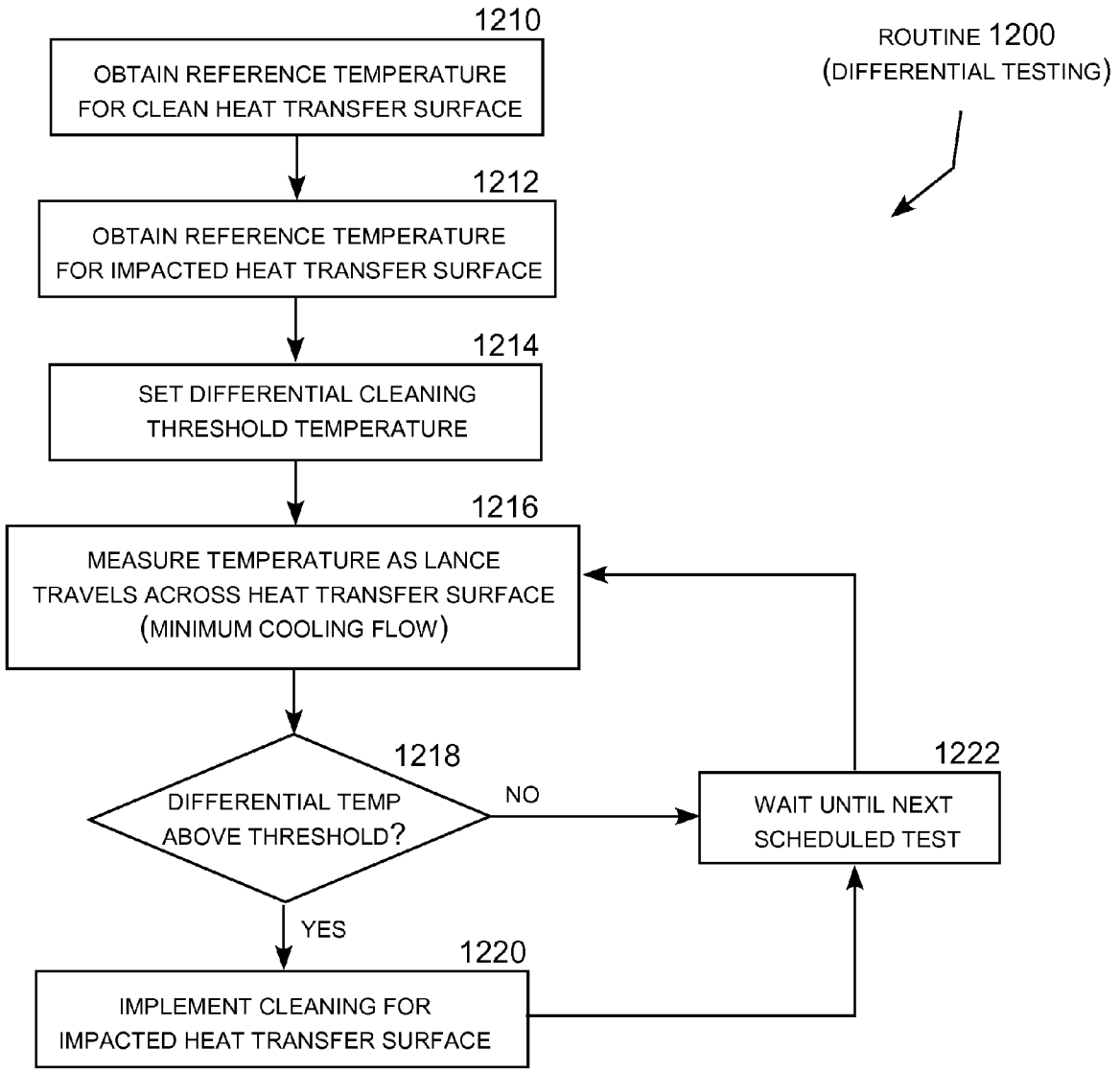
FIG. 12 is a logic flow diagram illustrating a routine for activating a boiler cleaning operation in response to differential flue gas temperatures across a heat transfer surface measured with the temperature sensing sootblower.

FIG. 12 is a logic flow diagram illustrating a routine 1200 for activating a boiler cleaning operation in response to differential flue gas temperatures measured with the temperature sensing sootblower. In step 1210, a reference temperature for a clean heat transfer surface is obtained, typically by measuring the temperature of the heat transfer surface when it is known to be in a clean state or through computer simulation. Step 1210 is followed by step 1212, in which a reference temperature for a heat transfer surface impacted by accumulated slag is obtained, again by measuring the temperature of the heat transfer surface when it is known to be in an impacted state or through computer simulation. Step 1212 is followed by step 1214, in which the boiler cleaning controller is programmed with a differential cleaning threshold temperature based on the clean and impacted reference temperatures. For example, the differential cleaning threshold temperature may be set to 25% of the difference between the clean and impacted references temperatures below the clean reference temperature. Step 1214 is followed by step 1216, in which the boiler cleaning controller activates the temperature sensing sootblower to measure the boiler temperature as the lance travels past a targeted heat transfer surface while maintaining a minimum cleaning fluid flow necessary to avoid overheating of the lance (see FIG. 14). Step 1216 is followed by step 1218, in which the boiler cleaning controller determines whether the measured temperature is above the differential cleaning threshold temperature indicating the presence of a portion of a heat transfer surface requiring cleaning. If the measured temperature is above the differential cleaning threshold temperature, the "YES" branch is followed to step 1220, in which the sootblower is activated to clean the impacted portion of the heat transfer surface. If the measured temperature is not above the differential cleaning threshold temperature, the "NO" branch is followed to step 1222, in which the sootblower cleaning controller waits for another scheduled test. Step 1220 is also followed by step 1222, which loops to step 1216, in which the differential boiler temperature is measured with the temperature sensing sootblower as the lance travels past the targeted heat transfer surface.

It will be appreciated that Routine 1100 may be implemented for an initial cleaning cycle and routine 1200 may be implemented to further clean any surfaces or portions of that were not fully cleaned during an initial cleaning cycle. Routines 1100 and 1200 may also be combined into a single routine implementing cleaning based on absolute and differential temperatures at the same time.

Figure 13:
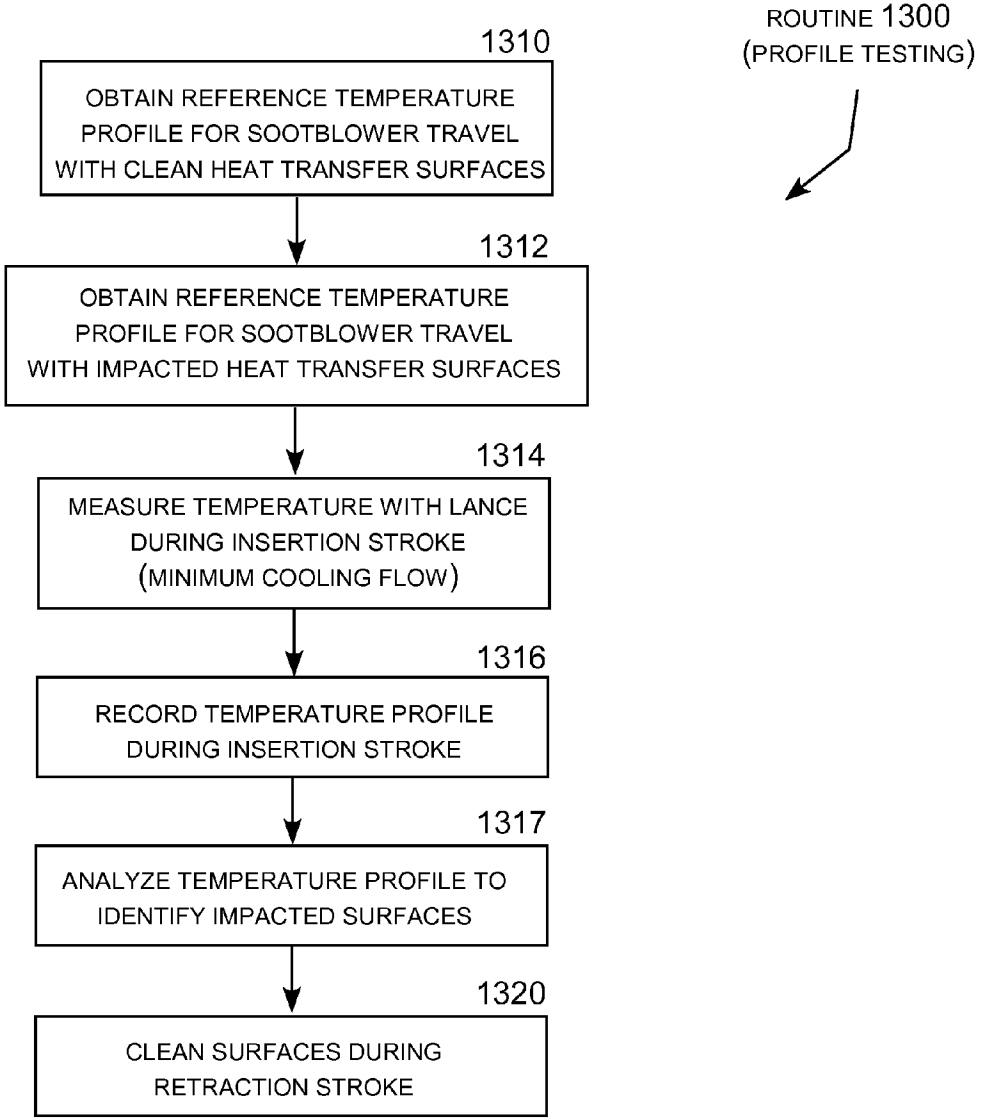
FIG. 13 is a logic flow diagram illustrating a routine for controlling a boiler cleaning operation based on temperature profile testing.

FIG. 13 is a logic flow diagram illustrating a routine 1300 for activating a boiler cleaning operation in response to temperature profile testing. In step 1310, a reference temperature profile is obtained for sootblower travel across clean heat transfer surfaces, typically by measuring the temperature profile as the sootblower lance travels past the heat transfer surfaces when they is known to be in a clean state or through computer simulation. Step 1310 is followed by step 1312, in which a reference temperature profile is obtained for sootblower travel across impacted heat transfer surfaces, again by measuring the temperature profile as the sootblower lance travels past the heat transfer surfaces when they are known to be in an impacted state or through computer simulation. Step 1312 is followed by step 1314, in which the boiler cleaning controller obtains a temperature profile for the heat transfer surfaces during the insertion stroke of the lance while maintaining a minimum cooling flow through the lance (see FIG. 14). Step 1314 is followed by step 1316, in which the boiler cleaning controller records the temperature profile measured during the insertion stroke. Step 1316 is followed by step 1318, in which the boiler cleaning controller analyzes the measured temperature profile to determine a cleaning profile for the retraction stroke. Step 1318 is followed by step 1320, in which the boiler cleaning controller implements the cleaning profile during the retraction stroke.

Figure 14:
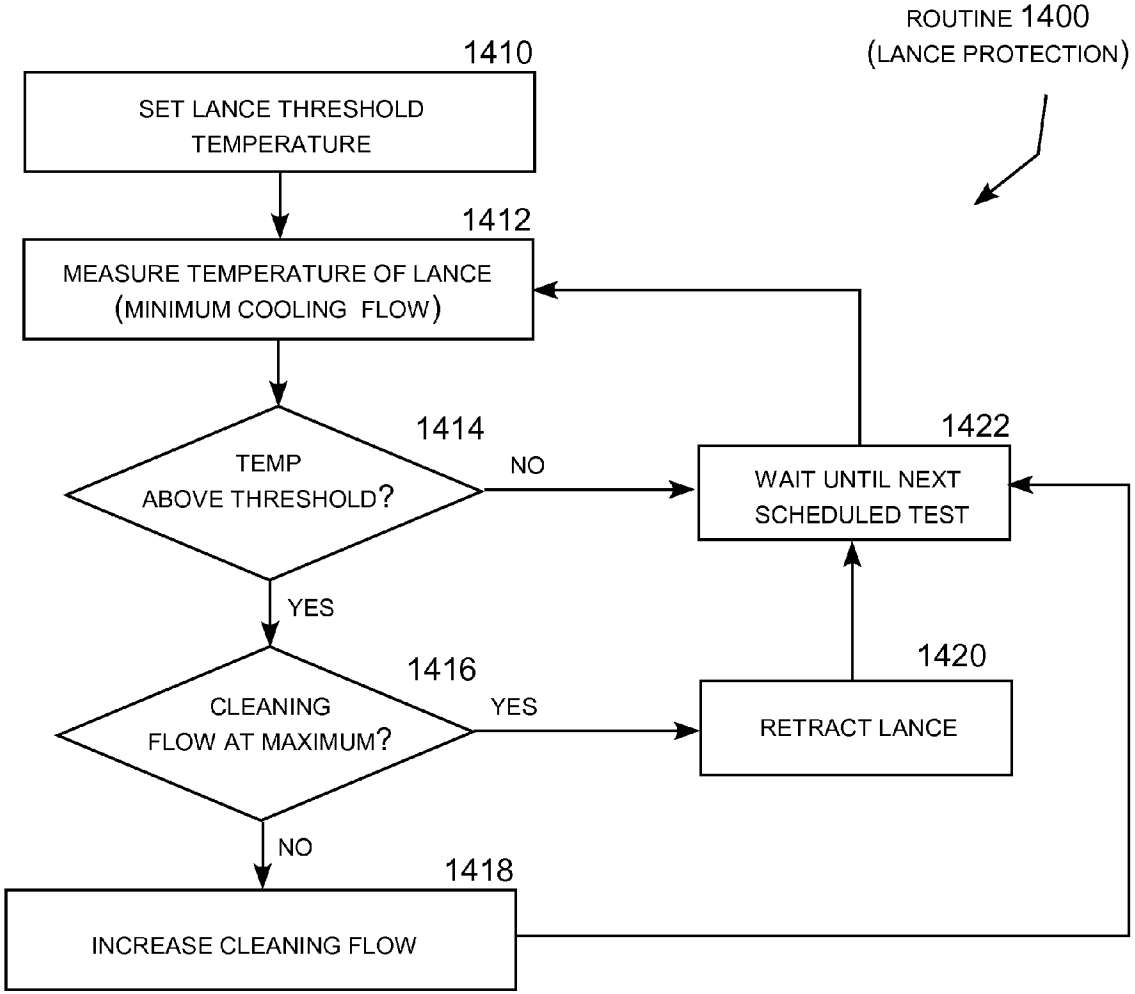
FIG. 14 is a logic flow diagram illustrating a routine for protecting the temperature sensing sootblower to avoid a potential overheating condition.

FIG. 14 is a logic flow diagram illustrating a routine 1400 for protecting the temperature sensing sootblower to avoid potential overheating. In step 1410, the boiler cleaning controller is programmed with a threshold temperature for protecting the lance tube to avoid overheating of the lance tube, which is typically based on the material specifications for the lance tube and experience. For example, the threshold temperature may be set to 1,200° F. Step 1410 is followed by step 1412, in which temperature sensing sootblower is located within the boiler, typically for cleaning or temperature sensing operations while maintaining a minimum cleaning fluid flow necessary to avoid overheating of the lance. Step 1412 is followed by step 1414, in which the boiler cleaning controller determines whether the measured temperature of the lance tube is above the threshold temperature indicating potential overheating of the lance tube. If the measured temperature is above the threshold temperature, the "YES" branch is followed to step 1416, in which boiler cleaning controller determines whether the cleaning fluid flow through the sootblower is set to its maximum level. If the measured temperature is not set to its maximum level, the "NO" branch is followed to step 1418, in which the boiler cleaning controller increases the cleaning fluid flow through the sootblower by an incremental amount, such as 10% of the maximum cleaning fluid flow through the sootblower. If the measured temperature is set to its maximum level, the "YES" branch is followed to step 1420, in which the boiler cleaning controller retracts the sootblower lance to prevent overheating. Returning to step 1414, if the measured temperature is not above the threshold temperature, the "NO" branch is followed to step 1422, in which the boiler cleaning controller waits for the next scheduled test. Step 1418 is also followed by step 1420, which loops back to step 1412, in which the temperature of the lance is measured.

The invention claimed is:

1. A temperature sensing sootblower, comprising:

an elongated lance tube configured to travel within a boiler while directing a cleaning fluid through one or more nozzles toward the heat transfer surface to remove fireside deposits from the heat transfer surface;

a temperature sensor carried by the lance tube within the boiler configured to obtain temperature measurements of flue gas within the boiler while the lance tube is located within the boiler; and a lance tube extension supporting the temperature sensor beyond a leading end of the lance tube in an insertion direction of the lance tube.

2. The temperature sensing sootblower of claim 1, wherein the temperature sensor is configured to obtain temperature measurements of the flue gas within the boiler while the lance tube travels within the boiler.

3. The temperature sensing sootblower of claim 2, further comprising a boiler cleaning controller configured to adjust the boiler cleaning operation in response to the temperature measurements from the temperature sensor.

4. The temperature sensing sootblower of claim 3, further comprising a data acquisition unit for receiving and recording the temperature measurements from the temperature sensor and transmitting the temperature measurements to the boiler cleaning controller.

5. The temperature sensing sootblower of claim 4, wherein the lance tube rotates and the data acquisition unit is fixed to a non-rotating structure, further comprising a data transfer device for transferring the temperature measurements from the temperature sensor to the data acquisition unit while the temperature sensor rotates with the lance tube.

6. The temperature sensing sootblower of claim 5, wherein the data transfer device comprises a slip ring fixed to the lance tube.

7. The temperature sensing sootblower of claim 1, wherein the lance tube extension supports the temperature sensor beyond the lance tube extension in the insertion direction.

8. The temperature sensing sootblower of claim 1, further comprising a groove in the lance tube, wherein the temperature sensor comprises a thermocouple positioned within the groove.

9. The temperature sensing sootblower of claim 8, further comprising a welding rod positioned above the thermocouple within the groove and an overlay weld positioned above the welding rod sealing the thermocouple within the groove.

10. The temperature sensing sootblower of claim 1, further comprising:

a second thermocouple in contact with the lance tube for measuring the temperature of the lance tube; and a third thermocouple extending through a hole in the lance tube into an interior of the lance tube for measuring the temperature of a cleaning fluid inside the lance tube.

11. A temperature sensing sootblower, comprising:

an elongated lance tube configured to travel within a boiler while directing a cleaning fluid through one or more nozzles toward a heat transfer surface to remove fireside deposits from the heat transfer surface;

a first temperature sensor carried by the lance tube within the boiler configured to obtain temperature measurements of the lance tube while the lance tube is located within the boiler; and a second temperature sensor carried by the lance tube within the boiler configured to obtain temperature measurements of flue gas within the boiler while the lance tube is located within the boiler wherein the second temperature sensor is supported by a lance tube extension beyond a leading edge of the lance tube in an insertion direction of the lance tube.

12. The temperature sensing sootblower of claim 11, wherein the first temperature sensor is configured to obtain temperature measurements of the lance tube while the lance tube travels within the boiler.

13. The temperature sensing sootblower of claim 11, further comprising a boiler cleaning controller configured to increase the flow rate of the blowing medium and/or to retract the lance tube in response to temperature measurements from the first temperature sensor indicating that the lance tube has exceeded a predetermined temperature.

14. The temperature sensing sootblower of claim 13, further comprising a data acquisition unit for receiving and recording the temperature measurements from the temperature sensors and transmitting the temperature measurements to the boiler cleaning controller.

15. The temperature sensing sootblower of claim 14, wherein the lance tube rotates and the data acquisition unit is fixed to a non-rotating structure, further comprising a data transfer device for transferring the temperature measurements from the temperature sensors to the data acquisition unit while the temperature sensor rotates with the lance tube.

16. The temperature sensing sootblower of claim 15, wherein the data transfer device comprises a slip ring fixed to the lance tube.

17. The temperature sensing sootblower of claim 11, further comprising a groove in the lance tube, wherein the first temperature sensor comprises a thermocouple positioned within the groove.

18. The temperature sensing sootblower of claim 17, further comprising a welding rod positioned above the thermocouple within the groove and an overlay weld positioned above the welding rod sealing the thermocouple within the groove.

19. A temperature sensing sootblower, comprising:

an elongated lance tube configured to travel within a boiler while directing a cleaning fluid through one or more nozzles toward a heat transfer surface to remove fireside deposits from the heat transfer surface;

a first temperature sensor extending through a hole in the lance tube into an interior of the lance tube for measuring the temperature of a cleaning fluid inside the lance tube while the lance tube is located within the boiler; and a second temperature sensor carried by the lance tube within the boiler configured to obtain temperature measurements of flue gas within the boiler while the lance tube is located within the boiler wherein the second temperature sensor is supported by a lance tube extension beyond a leading edge of the lance tube in an insertion direction of the lance tube.

20. The temperature sensing sootblower of claim 19, wherein the first temperature sensor is configured to obtain temperature measurements of the cleaning fluid inside the lance tube while the lance tube travels within the boiler.

21. The temperature sensing sootblower of claim 19, further comprising a groove in the lance tube, wherein the temperature sensor comprises a thermocouple positioned within the groove.

22. The temperature sensing sootblower of claim 21, further comprising a welding rod positioned above the thermocouple within the groove and an overlay weld positioned above the welding rod sealing the thermocouple within the groove.

* * * * *